United States Patent [19]

Benoit et al.

[11] 4,016,613

[45] Apr. 12, 1977

[54] BALANCED BUMPER MEANS FOR FURNITURE

[75] Inventors: Roland Benoit; Richard H. Duprey, both of Danielson, Conn.

[73] Assignee: InterRoyal Corporation, New York, N.Y.

[22] Filed: Nov. 24, 1975

[21] Appl. No.: 634,399

[52] U.S. Cl. ..... 5/317 R

[51] Int. Cl.[2] ..... A47C 21/00

[58] Field of Search ..... 5/317, 328; 248/345.1

[56] References Cited

UNITED STATES PATENTS

| | | | |
|---|---|---|---|
| 1,082,160 | 12/1913 | Kurowski | 5/328 X |
| 1,445,726 | 2/1923 | Soros | 248/345.1 |

*Primary Examiner*—Paul R. Gilliam
*Assistant Examiner*—Andrew M. Calvert
*Attorney, Agent, or Firm*—Arthur A. March

[57] ABSTRACT

A bumper of a generally U-shaped tubular member whose free ends are pivotally attached to brackets which in turn are secured to the cross rod extending between the front legs of a bed or the like. A balancing spring contact engaging the bracket and the U-shaped bumper member maintains the bumper in lowered position extending from the head of the bed or in raised position wherein it does not substantially increase the length of the bed.

4 Claims, 4 Drawing Figures

FIG. 1
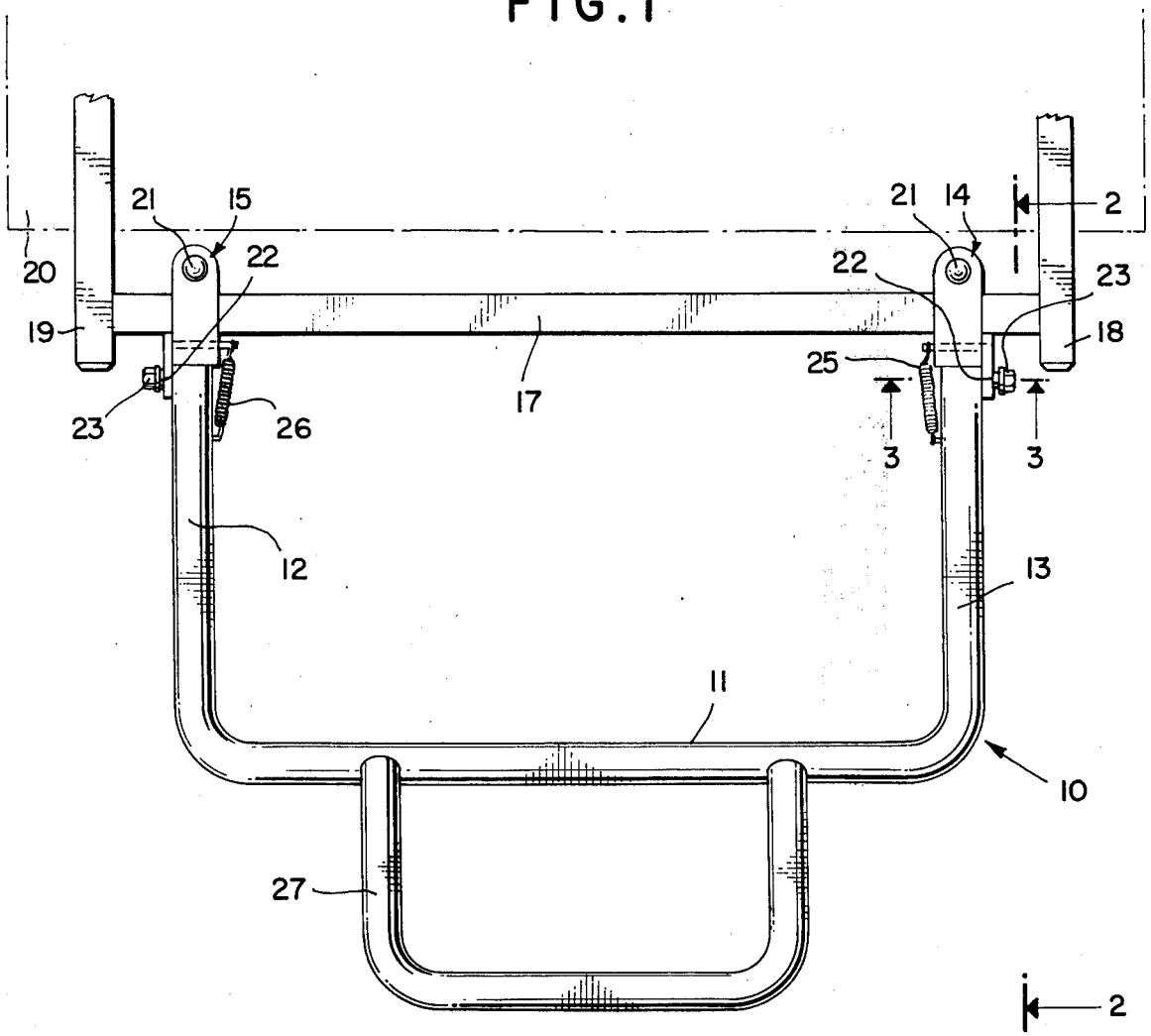
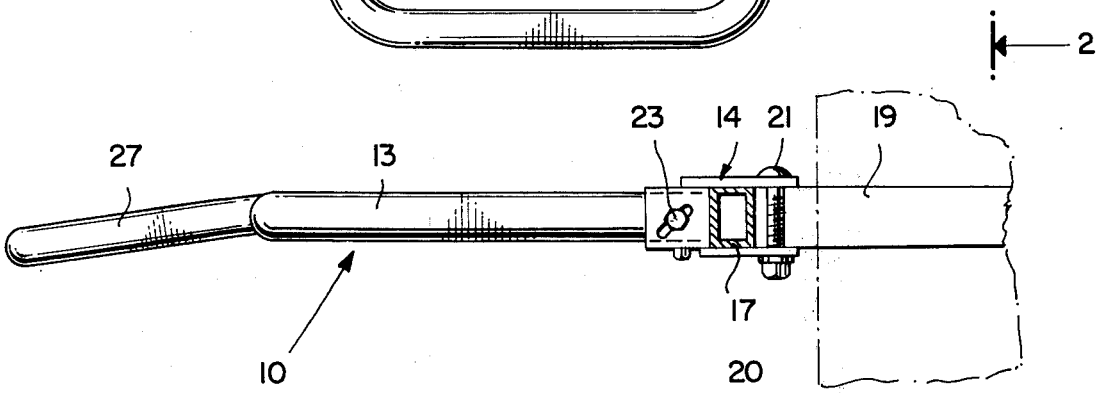
FIG. 2

FIG. 3
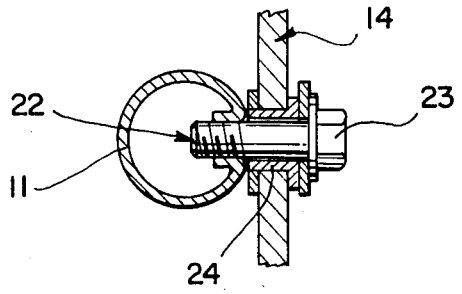
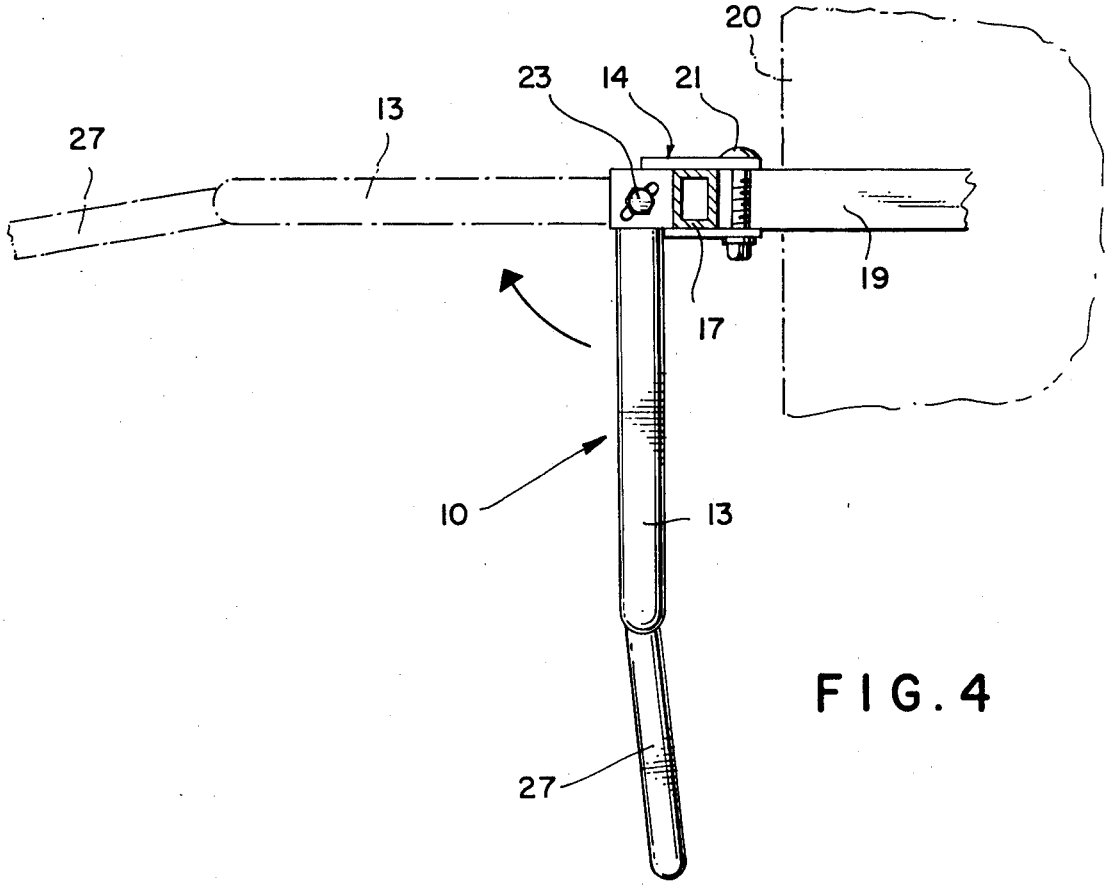
FIG. 4

BALANCED BUMPER MEANS FOR FURNITURE

BACKGROUND OF THE INVENTION

It is well-known that in many and varied situations, articles of furniture must necessarily be moved from one location to another. Such movement particularly is essential in connection with furniture equipment such as hospital beds and the like which must be periodically moved as different conditions demand.

Heretofore, considerable damage has been caused during such relocating movement by the collision of such equipment with walls, doors and other objects present in the area. This problem has become quite severe in view of the burgeoning costs of hospital equipment including hospital beds.

Attempts to overcome the problems by the provision of means extending from the forward or leading end of furniture such as hospital beds to prevent contact between the moving bed and other objects have resulted in the presentation of other objectionable difficulties. For example, such elongate extensions increased the overall length of the bed and, being rigid, prevented the bed from being accomodated in elevators or from being manipulatable in corridors. As a consequence, such extension means have not been widely utilized and there remains the continuing problem of damage to expensive hospital beds and other equipment caused by collisions during the course of relocating.

SUMMARY OF THE PRESENT INVENTION

The present invention has provided a new and novel structure substantially overcoming all of the foregoing problems. This solution has been accomplished by the provision of a pivotable bumper structure which extends forwardly of the extreme front end of furniture, as for example, a hospital bed. Thus extended, the bumper prevents the bed itself from colliding with other objects or walls thereby avoiding damage to the bed. Furthermore, any impact at the narrow front end of the bumper would not cause serious damage to other objects. Of particular importance, however, in the concept of the bumper construction of the present invention is in that while the bumper is normally extended in lowered position forwardly of the head and lower portion of the bed, the bumper may nonetheless be moved to a raised position wherein it will located somewhat to the rear of the front end of the bed. Thus, the bumper in this position will not add to the length of the bed when it is being moved through narrow corridors or in elevators or the like.

These beneficial results are accomplished by the provision of a relatively U-shaped tubular member whose free ends are attached to brackets which are in turn secured adjacent the ends of the cross bar extending between the front legs of the bed itself. The U-shaped member is pivotally connected to the bracket and may be moved from a position in which it extends forwardly of the bed, in an upward arc to a raised position parallel to the plane of headboard. Uniquely constructed spring elements are provided around the pivot point of the U-shaped bumper and the bracket. These elements are so tensioned as to normally urge the bumper to automatically assume a lowered extended position once it achieves a greater than predetermined angular relation with the head of the bed while nevertheless maintaining the bumper section in a raised, upwardly disposed manner when the angular relation between the bumper and the head of the bed is lesser than the predetermined angle. Thus, this uniquely disposed spring means acts as the control for maintaining the bumper in its ultimate position depending upon the desire of the user.

Furthermore, the structure presented by the present invention has unique advantages when utilized with a bed which may be mechanically or automatically moved from high to low position, in other words, the well-known hi-lo type of hospital bed. When the bed is in high position, which is often the position when relocating the bed, the bumper is raised for movement through corridors and narrow spaces. When the bed has reached its destination and the frame is being lowered to the low position, the head of the bed frame will contact the upwardly extending bumper and cause it to be gently pushed to a point where the spring control causes it to automatically assume the lowered extended position. This feature also has great advantages if the bed is placed in too close a proximity to a wall or other object when it is in high position. If this should occur, when the bed is moved to a low position, the frame will not contact the wall or other rigid object and cause damage but instead the frame will contact the upraised bumper and lower it into the position where only the bumper will engage the wall or other rigid object thus preventing damage to the bed itself.

The bumper of the present invention may also be provided, if desired, with a smaller U-shaped member secured to the cross bar of the U-shaped member which is attached to the bracket and bed. This smaller U-shaped member may be angularly disposed with relation to the front U-shaped member so that while it adds an extended length to the bumper section, it nevertheless does not interfere when in raised position.

In this specification, the bumper is, for the most part, described in relationship to a hospital bed. However, the structure is equally applicable to any moving furniture equipment which can utilize the advantages obtained by the present invention.

BRIEF DESCRIPTION OF THE DRAWINGS

FIG. 1 is a perspective view of the bumper of the present invention in its lowered extended position.

FIG. 2 is a section taken along the lines 2—2 of FIG. 1.

FIG. 3 is a section taken along the lines 3—3 of FIG. 1.

FIG. 4 is a perspective view of the bumper of the present invention in its raised position showing in dotted lines the approximate angle at which the bumper will automatically move downwardly to the lowered extended position.

DETAILED DESCRIPTION OF THE PRESENT INVENTION

As shown on the drawings, the present invention provides a bumper structure generally designated by the number 10. This structure comprises a tubular member 11, having two free ends, 12 and 13, which is generally U-shaped in configuration.

A pair of bracket assemblies 14 and 15 are secured to a cross bar member 17 which is connected between the legs 18 and 19 of the furniture equipment shown for illustrative purposes as a hospital bed 20. The brackets are secured near the ends of the cross bar 17 and are attached to the cross rod member by any suitable means, as for example by the illustrated nut and bolt connection 21. The free ends 12 and 13 of the U-shaped tubular member 11 are pivotally connected at 22 to the bracket members 14 and 15. This pivot is accomplished through the bolt 23 through bushing 24 connection into the tubular member 11. The U-shaped bumper section 11 may be moved as desired upwardly or downwardly around the pivot point 22. Thus, a bumper means is presented which extends forwardly of the head of a bed structure which can encounter walls or objects in the path of the bed when it is being moved before any damage is caused by a collision between such objects and the bed itself.

In accordance with the present invention, a new and distinct utilitarian advantage is obtained by the provision and disposition of spring elements 25 and 26, which are preferably located adjacent to and in proximity with the pivot point 22 between the brackets 14 and 15 and the free ends 12 and 13 of the tubular member 11. The construction and tension of these springs is in accordance with the concept carefully produced so as to achieve a particular point of balance for the purposes heretofore set forth.

One end of each spring 25 and 26 is attached to respective bracket members 14 and 15 while the other ends are respectively attached to the free ends 12 and 13 of the tubular member 11. These springs are so constructed and arranged that they will maintain the bumper structure 10 in the lowered extended position as shown in FIG. 1 when this position is desired while also maintaining the bumper structure 10 in its raised position as shown in FIG. 4, when this position is desired. Therefore, it will be seen that when the bumper member is in operative lowered position, it will be the first to encounter objects in the path of the moving bed as aforesaid. However, when it is desired to move the bed through narrow corridors and elevators or in confined areas, the bumper will be maintained in raised position out of the way and providing no extension to the length of the bed itself. Thus, the present invention provides means by which the problems attendant upon damaging the bed or other objects in relocation movement are overcome while nonetheless when desired, does not add to the length of the bed to in any way prevent the bed from being easily manipulated.

The balance of the springs 25 and 26 are such that when the angle of the tubular member with relation to the bed become larger than the angle shown in dotted lines in FIG. 4, the spring action will automatically cause the bumper to be lowered to the lowered extended position shown in FIG. 1. On the other hand, when the angle of the tubular member 11 with relation to the bed 20 is smaller than the angle shown in dotted lines in FIG. 4, the bumper will be automatically raised to the upward position shown in FIG. 4.

It will be understood that while a particular angularly disposed balancing position has been illustrated herein, this position may be modified within limits by utilizing springs of somewhat different construction and tension, all within the scope and concept of the present invention.

When utilized in a hi-lo bed, the vary action of the bed itself going from high to low position will cause the bumper, when in raised position, to be automatically lowered to its lowered extended position. This is accomplished by pressure exerted by the front end of the frame against the raised bumper extension while the bed is being normally accurately lowered. This feature will prevent contact between the frame of the bed and a wall, door or any stationary object which might cause damage when a hi-lo bed is being adjusted from its high position to its low position which is a distinct added advantage accomplished by the invention.

In addition, the spring balance described above is so arranged that in the event anyone steps on or otherwise depresses the bumper when it is in extended position, no damage will be caused for the reason that when the bumper is depressed in this fashion, the springs cause it to be returned to the extended position immediately after the removal of the downward pressure. This feature is additionally extremely advantageous.

As shown, the bumper structure generally may, if desired, be provided with another but somewhat smaller U-shaped member 27 extending from the front end of the tubular member 11 and angularly diposed with relation thereto. This provides additional length to the bumper structure but by reason of the angular disposition, this portion will be directed rearwardly when the bumper is raised to the position shown in FIG. 4 whereby it does not extend forwardly of the bed itself despite the additional length.

It will therefore be seen that the present invention provides a useful and novel structure for the protection of hospital beds and similar moveable furniture which protects the furniture and other objects during a collision. In addition, there is little, if any, addition to the length of the bed during movement through halls, corridors, elevators or other confined quarters.

We claim:

1. A bumper structure for hospital beds having legs with a cross bar therebetween comprising:

a pair of brackets for attachments to the cross bar at the front end of the bed;

a generally U-shaped bumper member having free ends each of which is secured to each of said brackets correspondingly; pivot members disposed between said brackets and said U-shaped bumper member enabling accurate movement of said U-shaped member from lower extended position to upwardly raised position;

biasing means secured to a said bracket and a free end of said U-shaped bumper member adjacent said pivot member, said spring means automatically lowering said U-shaped member to said lower extended position when said member is below a predetermined angular position with relation to the bed and automatically raising said U-shaped member to said upwardly raised position when said member is above a predetermined angular position with relation to the bed.

2. The bumper structure of claim 1 including a second generally U-shaped bumper extension secured to the forward end of the first generally U-shaped bumper member.

3. The bumper structure of claim 2 in which the second bumper member is offset to the first bumper member.

4. The bumper structure of claim 1 in which the maintaining meams for said U-shaped member support the said member in close proximity to the front end of the bed in upwardly raised position.

* * * * *